US007941907B2

(12) United States Patent
Yang et al.

(10) Patent No.: US 7,941,907 B2
(45) Date of Patent: May 17, 2011

(54) METHOD FOR MANUFACTURE OF SHAPED TUBULAR PART

(75) Inventors: Wihua Yang, Ann Arbor, MI (US); Charles J. Bruggemann, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1233 days.

(21) Appl. No.: 11/554,779

(22) Filed: Oct. 31, 2006

(65) Prior Publication Data

US 2008/0120844 A1 May 29, 2008

(51) Int. Cl.
*B23P 17/00* (2006.01)

(52) U.S. Cl. ..... 29/419.2; 29/421; 29/458; 29/507; 29/508; 29/505

(58) Field of Classification Search ..... 29/429.2, 29/421.1, 458, 507, 508, 518, 505, 419.2; 72/56, 61, 62; 403/282, 285; 219/603, 617, 219/611, 633, 635
See application file for complete search history.

(56) References Cited

U.S. PATENT DOCUMENTS

| | | | | | |
|---|---|---|---|---|---|
| 2,914,641 | A * | 11/1959 | Yuhasz | 219/611 |
| 3,633,266 | A * | 1/1972 | Taylor | 228/173.4 |
| 5,720,092 | A | 2/1998 | Ni et al. | 29/421.1 |
| 5,966,813 | A * | 10/1999 | Durand | 29/897.2 |
| 6,104,012 | A * | 8/2000 | Durand | 219/617 |
| 6,477,774 | B1 | 11/2002 | Marando et al. | 29/897.2 |
| 6,523,876 | B1 | 2/2003 | Durand | 296/35.1 |
| 6,654,995 | B1 | 12/2003 | Wang et al. | 29/421.1 |
| 6,742,258 | B2 | 6/2004 | Tarbutton et al. | 29/897 |
| 6,812,439 | B1 | 11/2004 | Durand et al. | 219/617 |
| 6,817,511 | B2 | 11/2004 | Durand | 228/115 |
| 7,140,530 | B2 * | 11/2006 | Durand et al. | 228/234.1 |
| 2002/0013617 | A1 * | 1/2002 | Matsutani et al. | 623/1.15 |
| 2002/0162224 | A1 * | 11/2002 | Gabbianelli et al. | 29/897.2 |
| 2003/0127453 | A1 * | 7/2003 | Kichline, Jr. | 219/617 |
| 2005/0193545 | A1 | 9/2005 | Keihl | 29/505 |
| 2005/0278924 | A1 | 12/2005 | Miller | 29/421.1 |
| 2006/0032895 | A1 | 2/2006 | Durand | 228/234.1 |

* cited by examiner

*Primary Examiner* — Derris H Banks
*Assistant Examiner* — Tai Nguyen

(57) ABSTRACT

A method is provided for manufacturing a shaped tubular part from a first tube and second tube. The end of the first tube is inserted into the end of the second tube to provide a region of overlapping tube walls. An induction coil is placed around the outer surface of the first and second tubes at the region of overlapped tube walls. The induction coil is energized to make a plurality of longitudinally spaced apart magnetic pulse welds attaching the tubes together to thereby form a multi-tube one-piece composite tubular assembly. The tubular assembly is then subjected to a forming process such as hydroforming, tube bending or stretch bending to form the final shape of the tubular part.

11 Claims, 3 Drawing Sheets

METHOD FOR MANUFACTURE OF SHAPED TUBULAR PART

FIELD OF THE INVENTION

The present invention relates to the manufacture of a shaped tubular part by joining together individual lengths of tube to form a single tubular assembly and then shaping the tubular assembly to form a finished tubular part of high strength.

BACKGROUND OF THE INVENTION

It is known in motor vehicles to provide a vehicle frame rail or roof rail or other structure by joining together a number of tubes. Sometimes the tubes are shaped and then joined together. In other cases the tubes are joined together and then shaped. Typical tube shaping processes include hydroforming and tube bending operations.

It would be desirable to provide an improved method for the manufacture of a shaped tubular part by joining together the individual lengths of tube via an improved high strength joint to form a tubular assembly which can then be shaped to form a finished tubular part of high strength.

SUMMARY OF THE INVENTION

A method is provided for manufacturing a shaped tubular part from a first tube and second tube. The end of the first tube is inserted into the end of the second tube to provide a region of overlapping tube walls. An induction coil is placed around the outer surface of the first and second tubes at the region of overlapped tube walls. The induction coil is energized to make a plurality of longitudinally spaced apart magnetic pulse welds attaching the tubes together to thereby form a one-piece composite tubular assembly. The tubular assembly is then subjected to a forming process such as hydroforming, tube bending or stretch bending to form the final shape of the tubular part.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is exemplary in nature and is not intended to limit the invention, its application, or uses.

Figure 1:
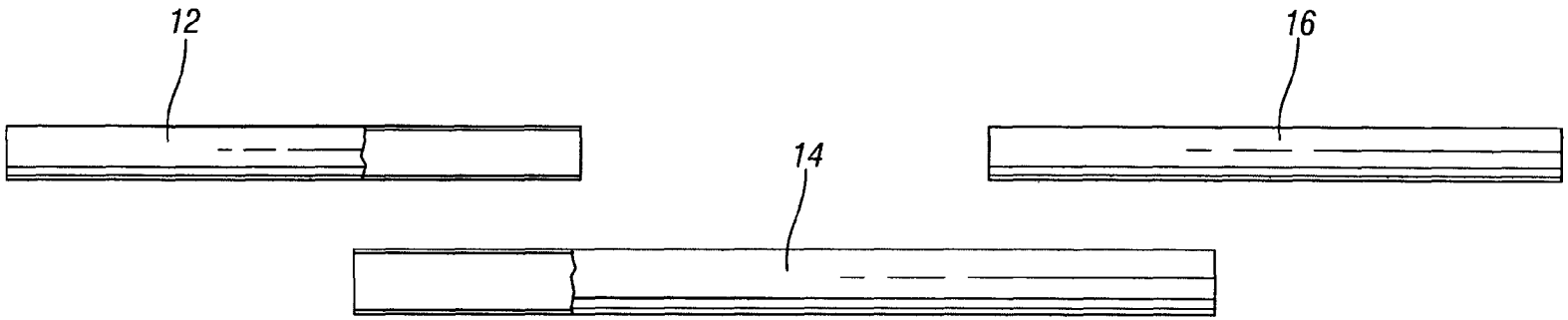
FIG. 1 is plan view showing three straight lengths of tube.

Referring to FIG. 1, three separate lengths of hollow tube 12, 14 and 16 are shown, and are intended to be assembled together and shaped and formed to provide a final product such as a frame rail for a motor vehicle. The tubes may be of ferrous metal or non ferrous metal. The tubes may all be of the same metal or of dissimilar metals. For example, the center tube 14 may be steel and the end tubes 12 and 16 may be aluminum or magnesium or other non ferrous metal. The center tube 14 is of greater diameter than the tubes 12 and 16.

Figure 2:
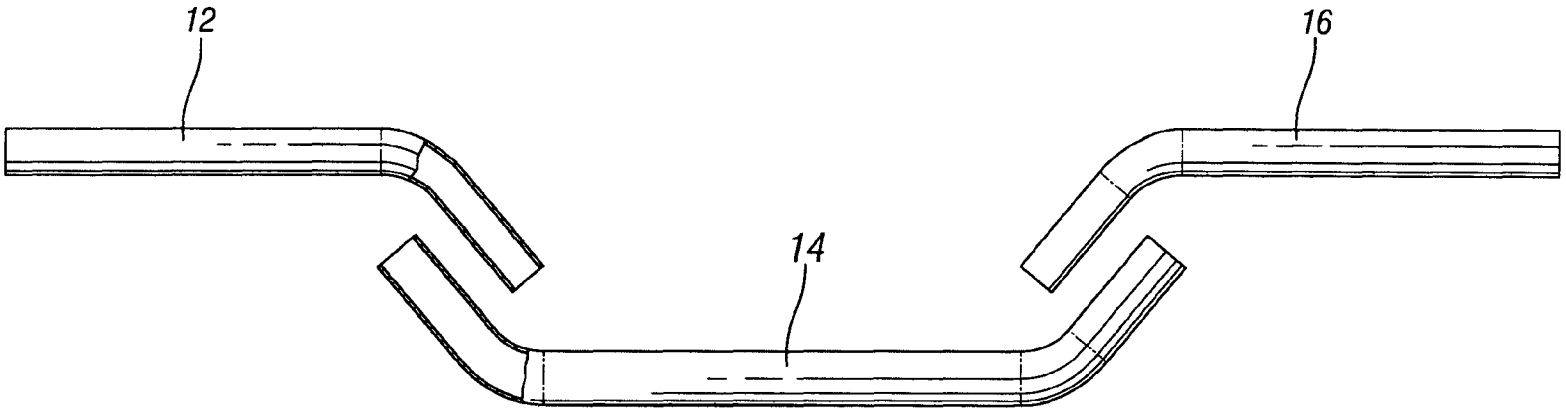
FIG. 2 is a plan view showing that the tubes of FIG. 1 have been bent to shape.

The tubes 12, 14 and 16 are bent in a tube bender to the shapes shown in FIG. 2.

Figure 3:
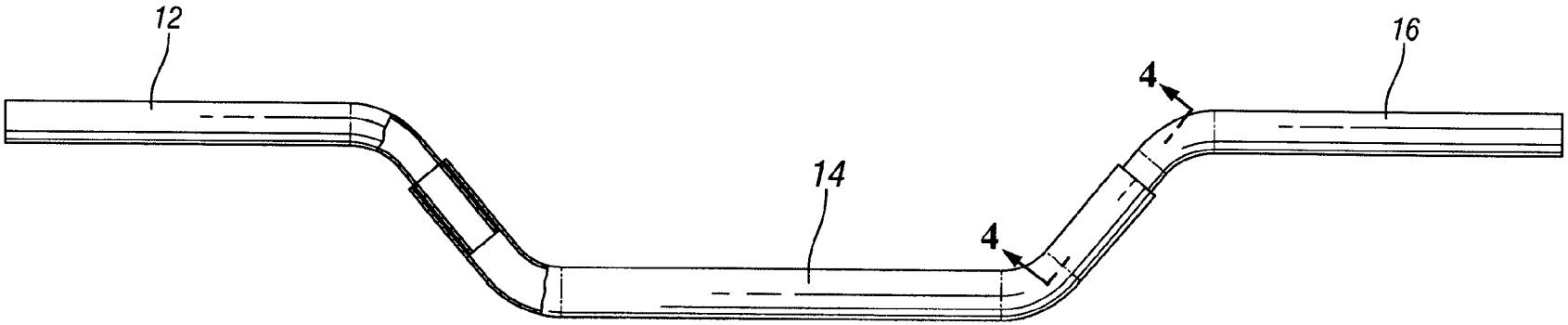
FIG. 3 is a plan view showing that the tubes have been lapped together.
Figure 4:
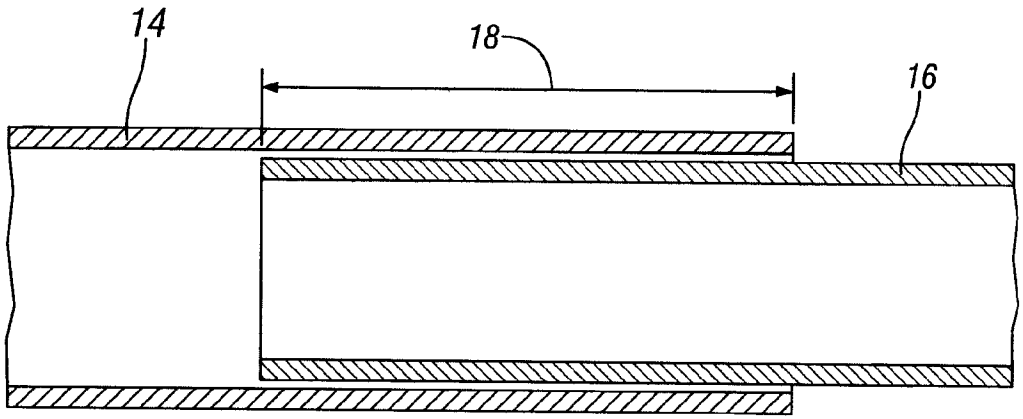
FIG. 4 is section view taken through the overlapped region of the tubes of FIG. 3.

Next, as shown in FIG. 3, the tubes are slipped together with ends of the larger diameter center tube 14 placed over the adjacent open ends of the tubes 12 and 16. As shown in FIG. 4, the tubes 14 and 16 overlap one another to thereby define an overlapped region designated 18. The length of the overlapped region 18 is preferably at least about twice the diameter of the tubes, but may be substantially greater, as discussed below.

Figure 5:
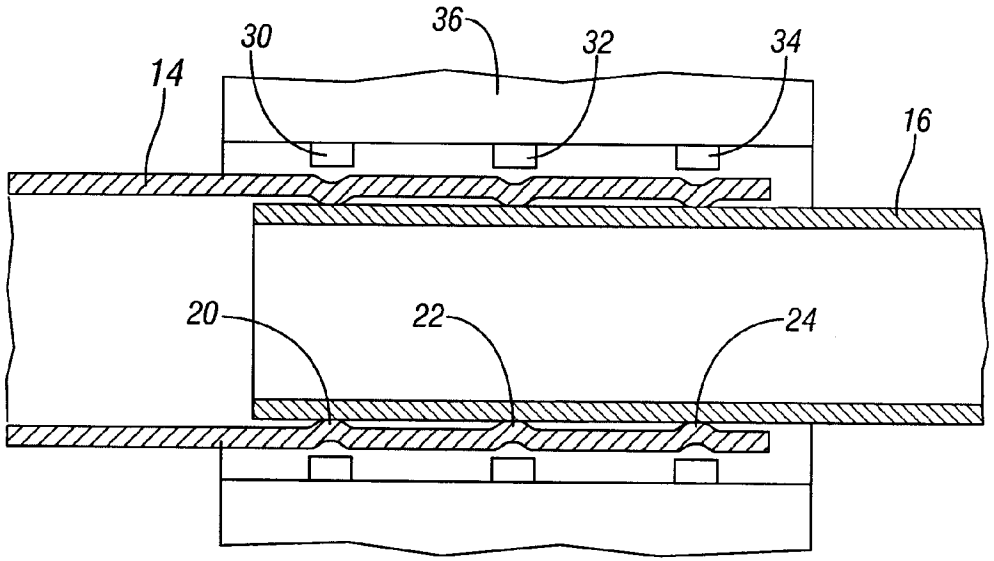
FIG. 5 is a view similar to FIG. 4 but showing the formation of a plurality of magnetic pulse welds to join the overlapped region of the tubes and thereby form a tubular assembly; and, FIG. 6 is a view similar to FIG. 3 but showing that the tubular assembly has been hydroformed to a final shape.

The separate tubes 12, 14, 16 are then joined together by magnetic pulse welding, as shown in FIG. 5, to form separate magnetic pulse welds 20, 22 and 24 that are spaced from one another along the length of the overlapped region 18. The magnetic pulse welding is performed by surrounding the tube 14 with an induction coil that is connected to a capacitor discharge supply. FIG. 5 shows three separate induction coils 30, 32 and 34 that are mounted on a common housing 36. The flow of current through the induction coils creates eddy currents in the tube 14 resulting in an intense magnetic field that is sufficiently high that the inner surface of the outer tube 14 is impacted against the outer surface of the inner tube 16 with such force as to produce a solid phase joint with very little heating of the tubes. The spacing between the induction coils 30, 32 and 34 will determine the spacing between the three separate magnetic pulse welds 20, 22, and 24 that join the two tubes 14 and 16. The tubes 12 and 14 are similarly welded together by similar magnetic pulse welds.

Figure 6:
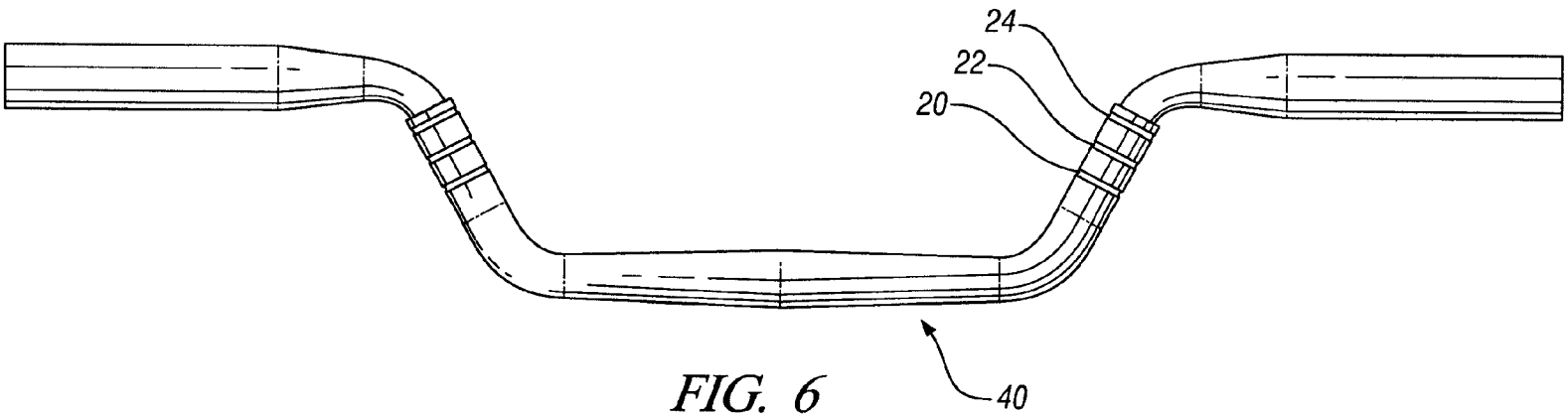

Referring now to FIG. 6, after the tubes 12, 14, and 16 are joined together by the magnetic pulse welding operation, the multi-tube one-piece tube assembly 40 created thereby is ready to be post-formed and shaped to its final configuration. FIG. 6 shows the example of the tube assembly 40 having been placed into the cavity of a hydroforming die set, not shown, and having been expanded radially to expand and modify the cross-sectional shape of the tube assembly where desired. For example, in FIG. 6, the ends of the tube assembly 40 are shown to have been enlarged. As an alternative to hydroforming, the tube assembly 40 could be post-formed and shaped in a tube bending operation or a stretch forming operation. Or, the tube assembly can be subjected to more than one post-forming operation, such as hydroforming and then bending, or bending and then hydroforming, etc.

The extent of the overlap of the tubes in the overlapped regions 18, combined with the joining together of the individual tubes by two or more of the longitudinally spaced apart magnetic pulse welds, provides a tube assembly 40 that is highly advantageous in providing the product designer and the process designer with the flexibility to achieve new economies and efficiencies. For example, in those instances where it is desirable for the finished part to have high strength in a particular region, the product may be designed to locate the overlapped and pulse welded region of the tube assembly at that location within the final part that needs to have the high strength. The overlap of the tubes provides a double thickness of tube wall, and the use of two or more pulse welds will introduce substantial strength into the tubes, also contributing to the high strength. In those instances where it is desirable for the finished part to have light weight and high strength, the method disclosed herein can enable the use of tubes of dissimilar metals, such as one of the tubes being aluminum or magnesium, and the other of the tubes being of a ferrous material.

In practicing the foregoing method, the designer will appreciate that the extent of the overlap between the tubes and the spacing between the individual magnetic pulse welds will allow tailoring of the performance of the final product. The overlap of the tubes may be as short as about one diameter of the tubes, or as long as many diameters of the tube.

The pulse welds can be relatively close together, for example about ½ of the tube diameter, or relatively farther apart, for example two or three tube diameters apart. In some instances, just two of the magnetic pulse welds may be needed, but in other applications, it may be desirable to employ three or four or more of the magnetic pulse welds spaced along the length of the overlap. In addition, the magnetic pulse welds can be evenly spaced from one another or the spacing between individual welds may vary along the length of the overlapped region. By selecting the spacing and number of the magnetic pulse welds, the designer can influence the ability of the overlapped region to be post-formed. For example, it may be desirable to place a magnetic pulse weld on each side of a particular location where a hole is to be pierced during hydroforming or a particular location where a tube bending operation is intended to create a bend in the overlapped region. Although the drawings herein show three separate induction coils mounted on a common housing, the method disclosed herein can also be performed using a single induction coil that will be moved along the length of the overlapped region 18 to create a succession of magnetic pulse welds.

Although the drawings herein show the example of a vehicle frame rail that is created by the magnetic pulse welding of three lengths of tube, it will be understood that two or three or more lengths of tube can be joined to form the tube assembly 40 and the resulting part can be for other applications in a motor vehicle or other article of manufacture. In addition, the tubes may have a circular, oval, rectangular, or other cross-sectional shape that can be overlapped with the adjacent tube by inserting one tube into another tube Thus the foregoing description of the invention is merely exemplary in nature and a person of ordinary skill in product and process design will recognize variations thereof within the scope of the invention.

What is claimed is:

1. A method of manufacturing a shaped tubular part from a first tube and second tube, comprising:

providing a first tube;

providing a second tube;

inserting the first tube into the second tube to provide a region of overlapping tube walls;

providing a plurality of induction coils spaced along the overlapped region and simultaneously energizing the plurality of induction coils to make a plurality of longitudinally spaced apart magnetic pulse welds attaching the tubes together to form a multi-tube one-piece tubular assembly, the spacing between the next adjacent of the plurality of magnetic pulse welds being in the range of about ½ the diameter of the overlapped tubes to about 3 times the diameter of the overlapped tubes;

and post-forming the tubular assembly to a desired shape forming the shaped tubular part.

2. The method of claim 1 further comprising said first and second tubes being of dissimilar metal.

3. The method of claim 1 in which at least one of the first and second tubes is pre-bent prior to the one tube being inserted into the other, at least three magnetic pulse welds are made in the overlapped region, and the post-forming operation includes hydroforming to shape the cross-sectional shape of the tube assembly.

4. The method of claim 3 further comprising the first and second tubes being of dissimilar metals.

5. A method of manufacturing a tubular structure from a plurality of separate straight tubes, comprising:

bending at least one of the separate tubes to a desired shape;

overlapping the tubes partially together by inserting the end of each tube into the end of an adjacent tube so that there are alternating regions of overlapped double thickness tube wall and regions of single thickness tube wall;

magnetic pulse welding the tubes together by providing a plurality of induction coils spaced along the overlapped double wall thickness tube wall regions and simultaneously energizing the plurality of induction coils to make a plurality of longitudinally spaced magnetic pulse welds at each of the overlapped regions; said magnetic pulse welds being spaced apart in the range of about ½ the diameter of the overlapped tubes to about 3 times the diameter of the overlapped tubes, whereby the separate tubes are joined to provide a tubular assembly;

and shaping the tubular assembly by performing at least one of hydroforming, tube bending, and stretch forming of the tubular assembly.

6. The method of claim 5 further comprising at least two of the plurality of separate tubes being of dissimilar metals.

7. The method of claim 5 further comprising at least one of the plurality of tubes being a ferrous metal and at least one of the plurality of tubes being a non-ferrous metal.

8. The method of claim 5 further comprising post-forming the tubular assembly by placing the tubular assembly in a hydroforming die cavity and introducing high pressure fluid to expand the tubular assembly outwardly to conform to the cross-sectional shape of the die cavity.

9. The method of claim 5 further comprising post-forming the tubular assembly by bending the tubular assembly in a tube bending device.

10. The method of claim 5 further comprising post-forming the tubular assembly by stretch forming the tubular assembly in stretch bending dies.

11. The method of claim 5 further comprising post-forming the tubular assembly by bending the tubular assembly in a tube bending device and then hydroforming the tubular assembly by placing the tubular assembly in a hydroforming die cavity and introducing high pressure fluid to expand the tubular assembly outwardly to conform to the cross-sectional shape of the die cavity.

* * * * *